United States Patent [19]

Stephen

[11] Patent Number: 4,947,298

[45] Date of Patent: Aug. 7, 1990

[54] BED LIGHTING APPARATUS

[76] Inventor: John L. Stephen, 811 Brentwood Way, Simpsonville, S.C. 29681

[21] Appl. No.: 396,317

[22] Filed: Aug. 21, 1989

[51] Int. Cl.[5] ..... A47B 23/06; A47B 97/00

[52] U.S. Cl. ..... 362/130; 362/802; 200/85 R; 200/DIG. 35

[58] Field of Search ..... 362/130, 802; 200/85, 200/DIG. 35

[56] References Cited

U.S. PATENT DOCUMENTS 2,185,051 12/1939 Daigle ..... 362/130
3,777,085 12/1973 Horn ..... 362/130 X
4,149,222 4/1979 Lind .
4,303,969 12/1981 Hamilton et al. .
4,340,929 7/1982 Konikoff et al. .
4,544,993 10/1985 Kirk ..... 362/801 X
4,565,910 1/1986 Musick et al. ..... 200/85
4,845,323 7/1989 Beggs ..... 200/85

*Primary Examiner*—Allen M. Ostrager
*Attorney, Agent, or Firm*—Leon Gilden

[57] ABSTRACT

A bed lighting apparatus is set forth wherein at least one, elongate elastomeric pad switch member is arranged between a mattress and box spring of an associated bed. Upon an individual arising from the bed, contact is made within the switch to illuminate a series of lights of conventional configuration, or alternatively LED lighting may be utilized. A manual over-ride switch is also utilized.

5 Claims, 3 Drawing Sheets

26
29
28
27
30
27

12
18
17a
17
13
17a
17
17a
17
19

14
15
15a
16a
16

BED LIGHTING APPARATUS

BACKGROUND OF THE INVENTION

1. Field of the Invention

The field of invention relates to bed lighting, and more particularly pertains to a new and improved bed lighting apparatus wherein the same is activated upon an individual arising from an associated bed.

2. Description of the Prior Art

The use of bed lighting apparatus is well known in the prior art. Heretofore the apparatus has been of a relatively elaborate or awkward organization for use in association with beds. Examples of the prior art include U.S. Pat. No. 2,185,051 to Daigle illustrating the use of an automatic bed light wherein the same utilizes a series of switch members underlying the box spring portion of a mattress wherein the same is actuated upon occupancy of an associated bed, as opposed to the instant invention to illuminate a surrounding environment upon an individual arising from a bed illuminates an associated area.

U.S. Pat. No. 4,149,222 to Linde sets forth a bed lighting apparatus cooperative with a wall mounted lighting fixture utilizing a switch cooperative with a drive means that is associated with a bed, such as a hospital bed.

U.S. Pat. No. 4,303,969 to Hamilton sets forth a dance floor arrangement with coupling members therebetween to illuminate the floor to provide illumination of a surrounding environment.

Similarly, U.S. Pat. No. 4,340,929 to Konikoff, et al., sets forth a further example of a floor illumination apparatus for illumination of a surrounding area as desired.

U.S. Pat. No. 4,544,993 to Kirk provides for an illumination bedside light unit that is actuated upon an individual directing a force onto the unit that is positioned independently of the bed.

As such, it may be appreciated that there is a continuing need for a new and improved bed lighting apparatus that actuates upon an individual arising from a bed and in this respect, the present invention substantially fulfills this need.

SUMMARY OF THE INVENTION

In view of the foregoing disadvantages inherent in the known types of bed lighting apparatus now present in the prior art, the present invention provides a bed lighting apparatus wherein the same is actuated upon an individual arising from a bed and effecting completion of a circuit thereby to illuminate a surround area adjacent the bed. As such, the general purpose of the present invention, which will be described subsequently in greater detail, is to provide a new and improved bed lighting apparatus which has all the advantages of the prior art bed lighting apparatus and none of the disadvantages.

To attain this, the present invention includes a plurality of switch pads positioned underlying a mattress portion of a bed wherein the switch member includes a presser plate and a contact plate secured together by a non-conductive shaft whereupon the presser plate displaces the contact plate from electrical association from contact portions within an elongate envelope whereupon an individual removing a force from the presser plate enables the contact plate to effect contact between the two associated contact plates within the elongate elastomeric envelope. A lighted bar member is securable to an associated bed frame for lighting an adjacent area in surrounding relationship to the bed.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed lighting apparatus which has all the advantages of the prior art bed lighting apparatus and none of the disadvantages.

It is another object of the present invention to provide a new and improved bed lighting apparatus which may be easily and efficiently manufactured and marketed.

It is a further object of the present invention to provide a new and improved bed lighting apparatus which is of a durable and reliable construction.

An even further object of the present invention is to provide a new and improved bed lighting apparatus which is susceptible of a low cost of manufacture with regard to both materials and labor, and which accordingly is then susceptible of low prices of sale to the consuming public, thereby making such bed lighting apparatus economically available to the buying public.

Still yet another object of the present invention is to provide a new and improved bed lighting apparatus which provides in the apparatuses and methods of the prior art some of the advantages thereof, while simultaneously overcoming some of the disadvantages normally associated therewith.

Still another object of the present invention is to provide a new and improved bed lighting apparatus wherein the same is actuated upon an individual alighting from an associated bed.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
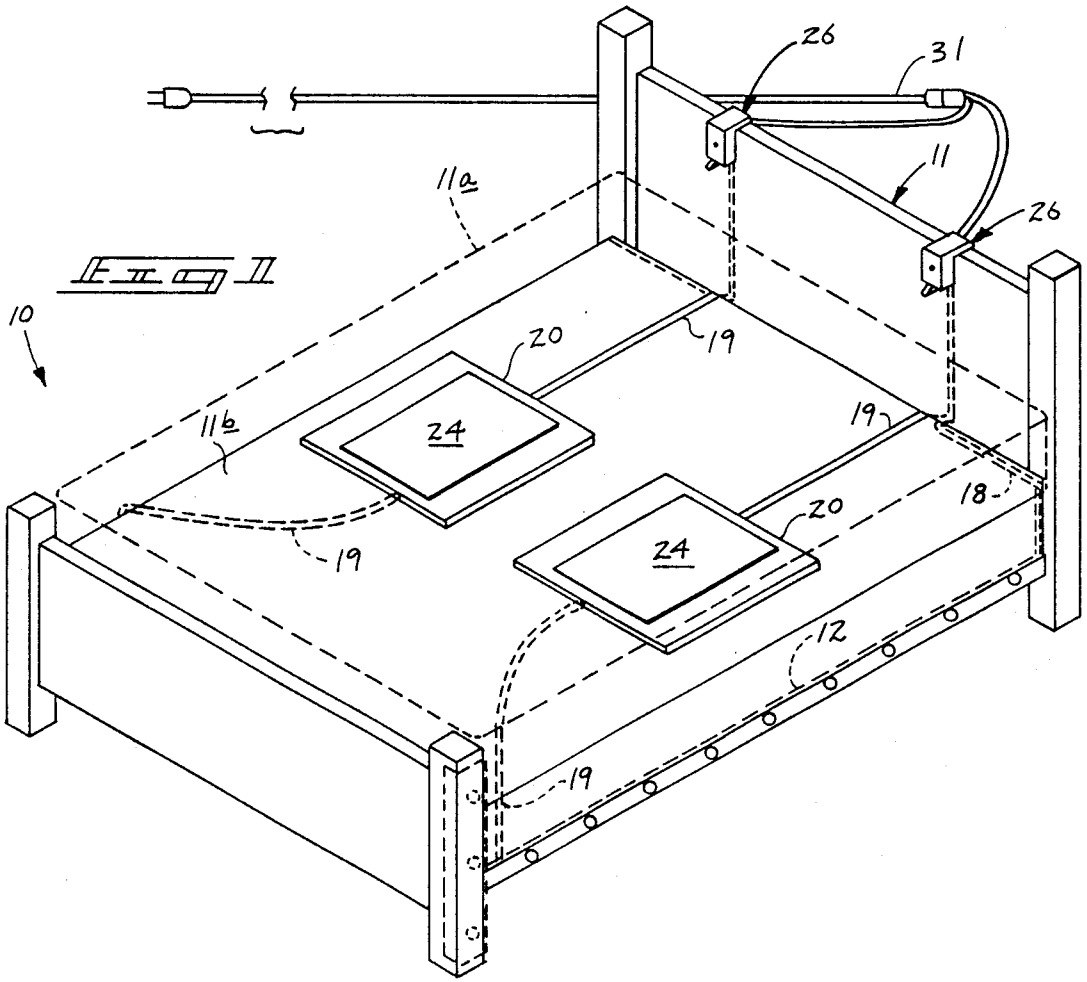
FIG. 1 is an isometric illustration of the instant invention in association with a conventional bed.
Figures 2, 3:
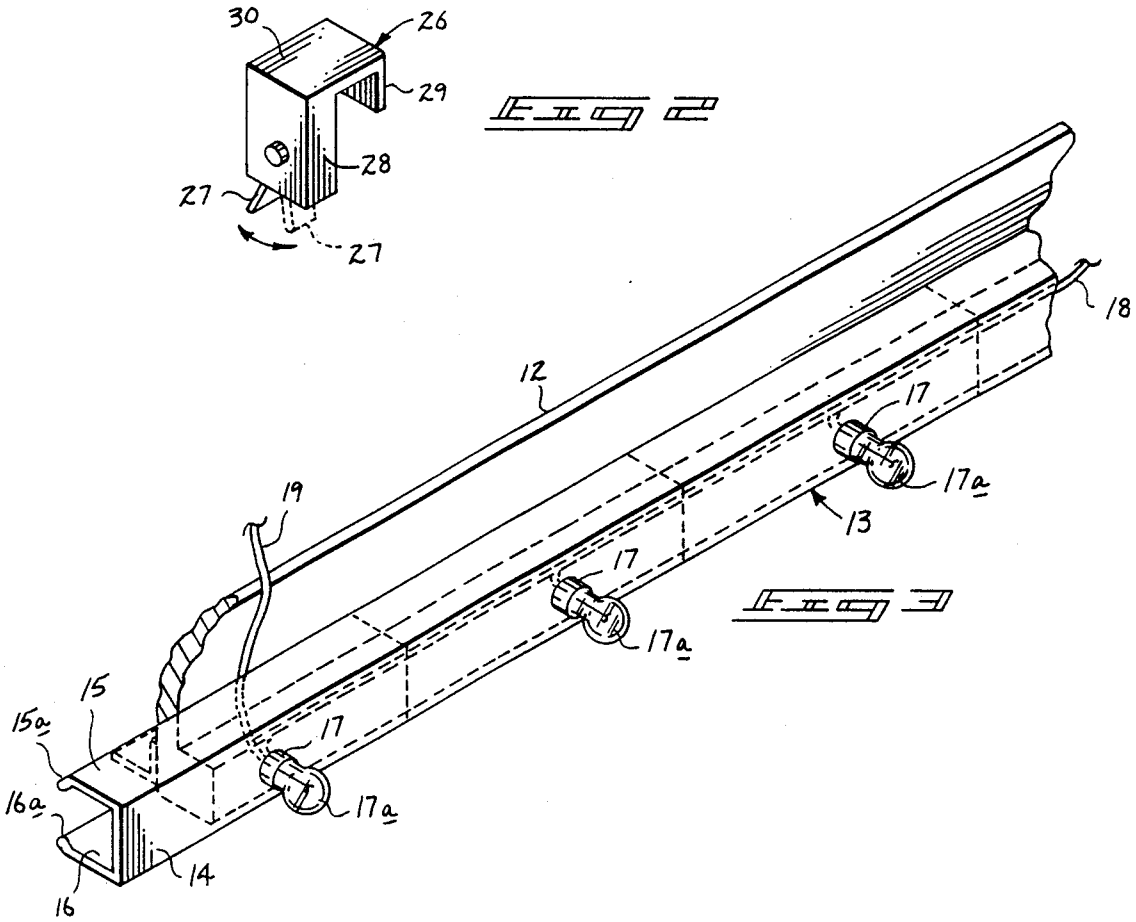
FIG. 2 is an isometric illustration of a manual switch utilized by the instant invention.
FIG. 3 is an isometric illustration of the light bar utilized by the instant invention.
Figure 4:
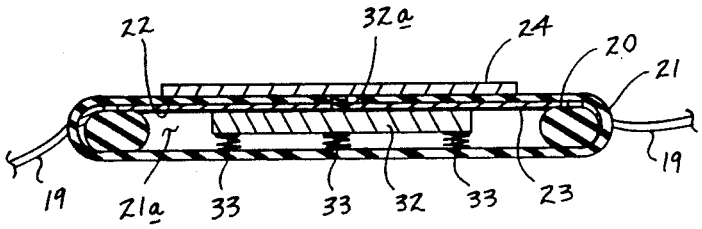
FIG. 4 is an orthographic cross-sectional view of the elongate switch pad utilized by the instant invention in an uncompressed configuration.
Figure 5:
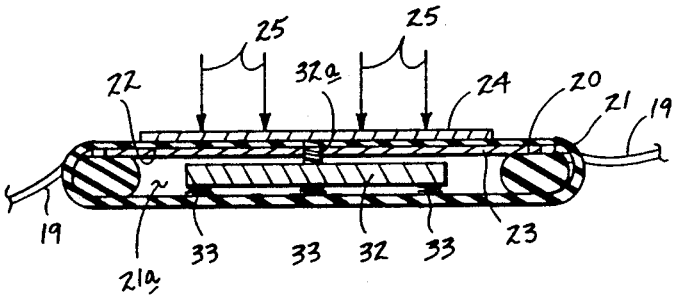
FIG. 5 is an orthographic cross-sectional view of the switch pad in a compressed configuration.

With reference now to the drawings, and in particular to FIGS. 1 to 5 thereof, a new and improved bed lighting apparatus embodying the principles and concepts of the present invention and generally designated by the reference numeral 10 will be described.

More specifically, the bed lighting apparatus 10 of the instant invention essentially comprises a combination in association with a bed 11 including a vertically positioned head board and side frame rails 12 supporting a mattress 11*a* overlying an associated box spring 11*b*.

An elongate "U" shaped light bar 13 is formed with a forward vertical wall 14 with an outwardly and orthogonally directed wall 15 parallel to and overlying a bottom wall 16. An elongate top wall lid 15*a* is directed downwardly relative to the top wall 15 with an elongate bottom wall lip 16*a* directed upwardly relative to the bottom wall 16 to encompass an associated frame rail 12, wherein the respective top and bottom walls 15 and 16 in cooperation with a forward wall 14 are of a complementary internal configuration to accommodate an external configuration of the frame rail 12. The light bar 13 includes a series of light bulb sockets 17 selectively receiving a series of light bulbs 17*a* therewithin. Alternatively, a series of LED lights may be utilized. An electrical circuit includes a common wire 18 with a switch wire 19, wherein the switch wire 19 is directed through one of a plurality of switch pads 20. The switch pads 20 are defined by an elongate elastomeric envelope 21 for positioning between the mattress 11*a* and the box spring 11*b*, as illustrated. The envelope 21 includes a first flexible contact plate 22 spaced from a second flexible contact plate 23. A force plate 24 overlies a top exterior surface of the envelope 21 and is connected to a "T" shaped contact plate 32 formed with a non-conductive shank 32*a*. Normally, plastic springs 33*a* direct the contact plate 32 into electrical communication between the first and second contact plates 22 and 23 respectively in a condition responsive to an individual not occupying an upper surface of the mattress 11*a*. Upon a force 25 applied to an upper surface of the mattress 11*a*, it will be transmitted into reception by the force plate 24 to disconnect electrical association between the plurality of first and second contact plates 22 and 23. The cavity 21*a* defined interiorly of the envelope 21 is of a width substantially less than that of the envelope 21, wherein the envelope 21 maintains the geometric configurational integrity of the cavity 21*a* to enable electrical disassociation of the "T" shaped contact plate 32 relative to the first and second plates 22 and 23. As the switch wire 19 is electrically associated with the first contact plate 22 and extends outwardly of the second contact plate 23, the switch wire 19 relies on electrical communication between the first and second contact plates 22 and 23 to complete a circuit. Further, the switch wire 19 is directed through a conventional switch 26 that has been mounted and includes a manual switch lever 27 extending from a forward leg 28 overlying a forward portion of the head board of the bed with a rear leg 29 and a connecting web 30 generally defining a "C" shaped switch member 26 to receive the bed frame therewithin. A power supply cord 31 directs electrical power to the various switches 26 in use. Each of the switches 26 controls an independent switch pad 20 and provides an over-ride function to electrically disassociate electrical power to the switch pads when lighting of a surround environment upon an individual arising from the bed 11 is not desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bed lighting apparatus in combination with a bed including a head board, a plurality of spaced elongate side frame rails supporting a box spring and overlying mattress, the apparatus comprising, a light bar means for securement to at least one of said side frame rails, and switch pad means in electrical association with said light bar means for completing an electrical circuit when a force is removed from application to an upper surface of said mattress, and a further switch member mounted on said head board for manually disconnecting electrical energy to the switch pad means, and wherein said light bar means comprises a generally "U" shaped elongate member defined by a forward wall mounting a series of light members thereon, and a top wall spaced from and parallel to a bottom wall, wherein each wall is orthogonally and integrally secured to the forward wall, and a top wall lip directed downwardly from a forward edge of said top wall, and a bottom wall lip directed upwardly from a forward edge of the bottom wall, and forward wall defining a channel of an internal complementary configuration of an external configuration defined by the frame rail.

2. A bed lighting apparatus as set forth in claim 1 wherein the switch pad means includes an elongate elastomeric envelope, and further including a first contact plate spaced from a second contact plate positioned within said envelope, wherein the first contact plate is spaced from the second contact plate, and a reciprocatably mounted "T" shaped contact plate spaced between the first and second contact plates including a non-conductive shank positioned between the first and second contact plates and an enlarged head member underlying the first and second contact plates, and non-conductive springs normally biasing the head in communication with the first and second contact plates, and a force plate positioned exteriorly of the envelope for biasing the head against the springs to electrically disassociate the head from the first and second contact plates.

3. A bed lighting apparatus as set forth in claim 2 wherein the further switch is defined by a "C" shaped member for receiving the head board therewithin, and wherein the switch includes a manually displaceable lever to enable manual disconnection of electrical energy to the switch pad means.

4. A bed lighting apparatus as set forth in claim 3 including a common wire directed to a first end of the light bar means with a switch wire directed through the further switch member and the switch pad means.

5. A bed lighting apparatus as set forth in claim 4 wherein the envelope defines a central cavity of a width substantially less than that of the envelope, wherein the cavity contains the shank and head portion contained within the envelope.

* * * * *